United States Patent [19]

Kovacs

[11] Patent Number: 5,076,613

[45] Date of Patent: Dec. 31, 1991

[54] LABEL OR PACKAGE CONSTRUCTION INCORPORATING HIDDEN INDICIA GAME

[76] Inventor: George W. Kovacs, 14411 Hardaway Dr., LaMirada, Calif. 90638

[21] Appl. No.: 504,012

[22] Filed: Apr. 4, 1990

[51] Int. Cl.[5] ..... B42D 15/00

[52] U.S. Cl. ..... 283/106; 273/138 R; 253/105; 253/81; 253/87; 253/91; 283/94; 283/107; 283/109; 283/903

[58] Field of Search ..... 283/72, 79, 80, 81, 283/87, 90, 91, 94, 106, 107, 108, 109, 105, 903

[56] References Cited

U.S. PATENT DOCUMENTS

| | | | |
|---|---|---|---|
| 102,200 | 4/1870 | Abraham | 283/94 X |
| 1,005,696 | 10/1911 | Czettel | 283/81 X |
| 1,273,105 | 7/1918 | Van Dyke et al. | 283/106 |
| 1,922,767 | 8/1933 | Humphner | 283/105 X |
| 2,167,305 | 7/1939 | Kropp | 283/105 X |
| 2,330,718 | 9/1943 | Kallmann | 283/90 X |
| 3,512,780 | 5/1970 | Allison | 283/903 X |
| 4,551,373 | 11/1985 | Conlon | 283/79 X |
| 4,708,369 | 11/1987 | Greig | 253/903 X |

FOREIGN PATENT DOCUMENTS 2351623 4/1975 Fed. Rep. of Germany .

*Primary Examiner*—Paul A. Bell
*Attorney, Agent, or Firm*—Irving Keschner

[57] ABSTRACT

Label or package construction incorporating a hidden, but purchaser-accessible, game piece. The label, on the part of the package incorporating the gamepiece, is comprised of multiple plastic layers, or plys, and has gamepiece indicia printed on opposite surfaces of a single layer or on contacting surfaces of adjacent layers. After the product incorporating the label or packaging is purchased, the customer removes the gamepiece portion and folds the portion in a manner such that the indicia containing area on the first layer surface is aligned with the indicia containing area on the second layer surface. When aligned, an indication is provided as to whether the customer is a prize winner.

2 Claims, 2 Drawing Sheets

FIG 1
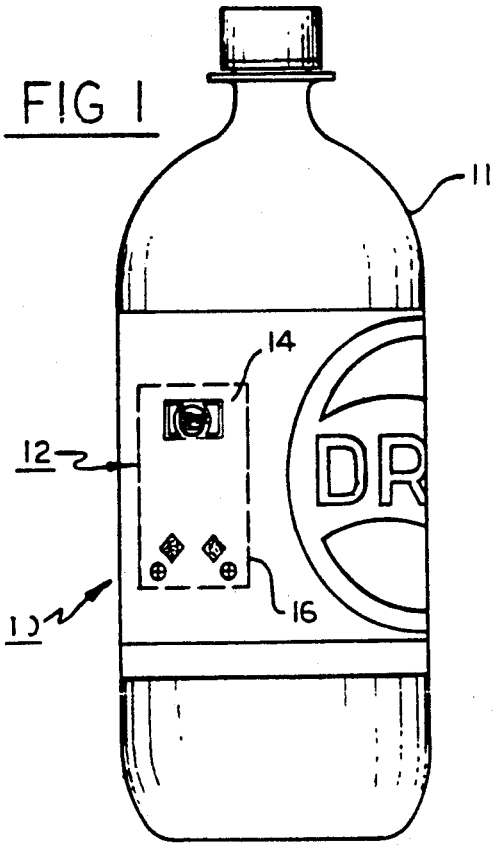
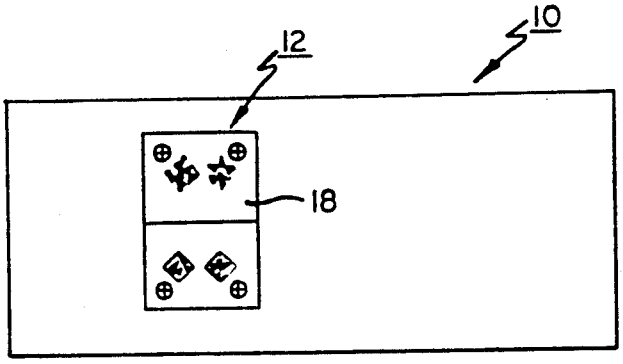
FIG 2
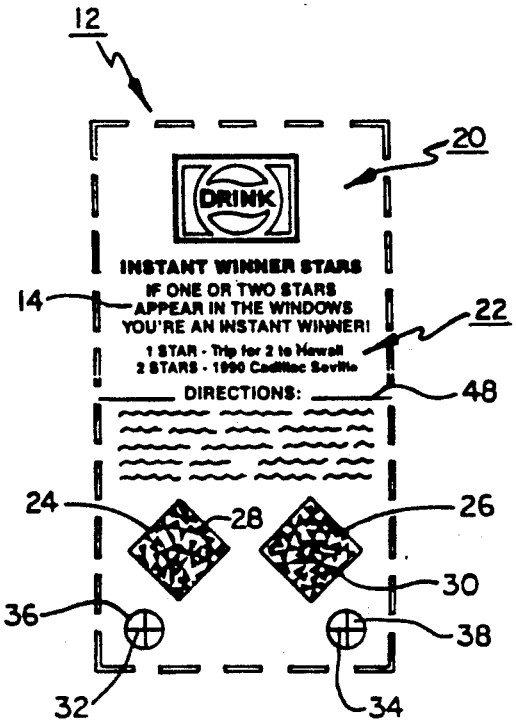
FIG 3
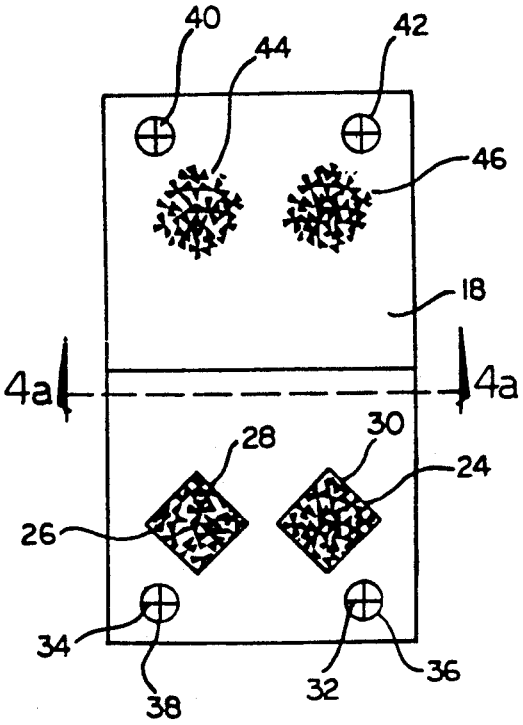
FIG 4

LABEL OR PACKAGE CONSTRUCTION INCORPORATING HIDDEN INDICIA GAME

BACKGROUND OF THE INVENTION

1. Field of the Invention

The present invention relates to gamepieces, and in particular, to a multiple layer packaging arrangement which incorporates a hidden, but purchaser-accessible, retail gamepiece, the indicia formed on separate layer surfaces forming a recognizable image when the gamepiece is folded in a particular manner.

2. Description of the Prior Art

The retailing of consumer products, as for example food products, household cleaning products, beverages and the like, is highly competitive and particularly so at the retail or point of sale level. Most of such consumer products are purveyed in cans, boxes, bottles, packets, packages and like containers that incorporate, or which may readily incorporate, distinctive printed labels that conventionally and distinctively identify the nature and source of the product contained therein. Such labels are usually adhesively secured to the product containers or are part of the package containing the product. Perhaps the most familiar and common examples thereof are the wraparound type of label conventionally found on canned goods and the paste-on labels conventionally employed on bottled beverages and which usually overlie only a portion of the available container surface and flexible packaging comprising multiple plastic layers.

Due to ever growing competitive pressures, recent years have witnessed a host of promotional concepts directed to the retail sales level to induce a purchaser to select a particular product. One of the common promotional concepts so employed is the "retail game" device, wherein the purchaser of a product is given a game card or other gamepiece at the time of purchase that offers a hope of a large return, often in a sweepstakes context. One such retail game device is the "Instant Winner" type, wherein the recipient of the gamepiece can immediately determine whether she or he is a winner or not. Such winners can be rewarded at the point of sale location or can receive their winning prize only after a return of the winning gamepiece to a redemption location. One of the recognized disadvantages of such retail game concepts is the fact that the product and the game card or gamepiece are physically separate entities and normally only come together at the time of actual purchase, as by a supermarket cashier handing the purchaser the gamepiece at the time of purchase at a checkout counter. Such physical separation of the product and the gamepiece not only creates opportunities for extensive abuse through intermediate handling of the gamepiece, but effectively removes control of the particular promotion from the producer of the product. While such disadvantages can be avoided by inclusion of the gamepiece within the product container, the added complication of packaging and purchaser access thereto, to say nothing of product contamination, had rendered such approach commercially impractical.

U.S. Pat. No. 4,551,373 to Conlon provides an approach which seeks to overcome the above disadvantage. The patent discloses a label element having a main body portion adapted to be adhesively secured to a product container, and an end portion that is foldable into overlying relation with a portion of the surface of the main body portion to form a composite and essentially coplanar exposed surface adapted to contain the distinctive product and source indicia thereon. The covered area of the label body portion includes a retail gamepiece that is exposable only by removal of a least a portion of the overlying foldable end portion by the purchaser of the product, the gamepiece being separably removable from the main body portion of the label following its exposure thereon.

Although the Colon patent is an improvement over prior hidden gamepiece label configurations, the label is relatively complex and expensive to fabricate in that multiple adhesive coatings are required and a separate removable gamepiece is incorporated within the label.

U.S. Pat. No. 4,708,369 to Greig discloses a gamepiece that includes a base sheet printed on one face with a visually ascertainable pattern of indicia, and a cover sheet also printed on one face with a visually ascertainable pattern of indicia which may or may not match the pattern on the base sheet. The one face of the base sheet on at least a band including the pattern of indicia, is provided with a transparent coating of permanent adhesive, and a liner layer is facially adhered thereto. The relative attraction of the permanent adhesive for the one surface of the base sheet and the liner layer is such that any attempt to remove the liner layer will substantially disrupt the one surface, thus giving evidence of an attempt to tamper with the pattern of indicia on the base sheet. The cover sheet is temporarily facially bonded to the liner layer or base sheet in such a way as to obscure the pattern of indicia on the base sheet from view until the temporary bonding of the cover sheet to the liner layer is disrupted, e.g. by peeling or tearing it away.

The gamepiece disclosed in the Greig patent is not designed to be incorporated directly on labels or packages and in addition, is relatively expensive to fabricate.

What is thus desired is to provide a simple and relatively inexpensive technique for incorporating an essentially tamperproof gamepiece with a product label or package, the gamepiece being physically joined with the product such that a consumer must purchase the product in order to have access to the gamepiece.

SUMMARY OF THE PRESENT INVENTION

The present invention provides a label or package construction incorporating a hidden but purchaser-accessible gamepiece. The label, or the part of the package, incorporating the gamepiece is comprised of multiple plastic layers, or plys, and has a gamepiece printed on the opposite surfaces of a single layer or on contacting surfaces of adjacent layers. After the product incorporating the label or packaging is purchased, the purchaser removes the gamepiece portion and folds the portion in a manner such that the indicia containing area on one layer surface is aligned with the indicia containing area on a second layer surface. When aligned, an indication is provided as to whether the customer is a prize winner. The gamepiece is printed at the time that the product identification indicia is printed on the label or packaging arrangement.

By enabling the gamepiece to be formed as part of the information printed on the product label or package in the manner described hereinabove, the present invention provides a relatively inexpensive technique for enabling manufacturers and/or retailers to offer an essentially tamperproof, hidden retail gamepiece and which requires the product to be purchased by a customer.

BRIEF DESCRIPTION OF THE DRAWINGS

For a better understanding of the invention as well as other objects and further features thereof, reference is made to the following description which is to be read in conjunction with the accompanying drawing wherein:

FIG. 1 is a perspective view of a product label having the gamepiece of the present invention printed thereon;

FIG. 2 is a rear view of the label shown in FIG. 1;

FIG. 3 is a detailed front view of the gamepiece shown in FIG. 1;

FIG. 4 is a detailed rear view of the gamepiece shown in FIG. 3;

DESCRIPTION OF THE PREFERRED EMBODIMENT

Figure 4A:
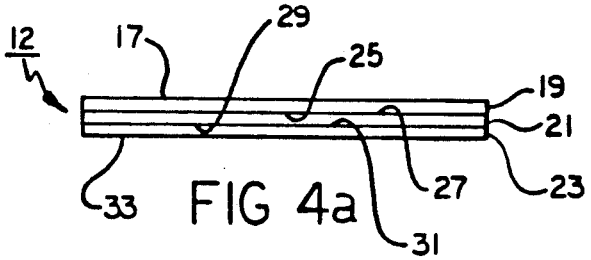
FIG. 4*a* is a cross-sectional view along line 4*a*—4*a* of FIG. 4.

Referring now to FIG. 1, a label 10 having a gamepiece 12 printed on a portion thereon in accordance with the teachings of the invention is illustrated. Label 10 is made of a conventional material used for labels and packaging purposes and comprises multiple layers, or plys, of transparent plastic material. After having the appropriate product and gamepiece information printed thereon, label 10 is affixed to a plastic bottle, can or similar container in a conventional manner. FIG. 1 shows label 10 affixed to a beverage container 11. for example. Gamepiece 12 has a purchaser viewable surface 14 and includes a dotted line arrangement 16 to indicate to the purchaser of the product that gamepiece 12 should be cut along those lines to remove it from the rest of label 10. FIG. 2 shows the rear, or non-accessible surface, 18 of gamepiece 12, label 10 being shown as removed from container 11 to clearly illustrate surface 18. As shown in more detail in FIG. 3, the viewable, or front, surface 14 of gamepiece 12 comprises a printed field, or area, 20 which may include the product identification indicia, such as a logo, and a second field 22 which has printed information relating to the gamepiece, including directions as to how purchasers of the product can determine if a prize has been won.

Figure 5:
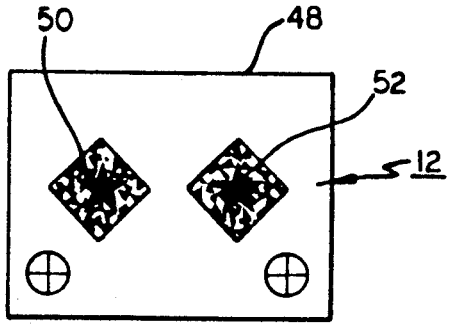
FIG. 5 illustrates the gamepiece shown in FIGS. 3 and 4 in the folded position.

In the embodiment illustrated, the lower portion of gamepiece 12 comprises two diamond shaped areas 24 and 26 which includes a pattern of printed markings 28 and 30 that are viewable by the potential purchaser of the container 11. FIG. 4 illustrates in more detail rear surface 18 of gamepiece 12. In accordance with the teachings of the present invention, label 10, and thus gamepiece 12, comprises a plurality of plastic layers 19, 21, and 23 (although three layers are shown, different numbers of layers can be utilized) as shown in FIG. 4*a*. Markings 28 and 30 are actually printed on surface 25 of layer 19 and are designed such that when gamepiece 12 is folded over along a line 48, registration marks 32 and 34 (printed on surface 25 at the same time as markings 28 and 30) are aligned with registration marks 40 and 42, respectively, printed on surface 27 of layer 21 of gamepiece 12 as illustrated. A series of markings 44 and 46 are also printed on surface 27 of layer 21 and positioned such that when the gamepiece is folded upwardly about line 48, the area of these markings align with areas 24 and 26. Markings 44 and 46 are selected in conjunction with markings 30 and 28, respectively, such that symbols are viewable through transparent areas 24 and 26 through surface 14 indicating whether the product purchaser has won a prize. FIG. 5 illustrates gamepiece 12 folded as noted hereinabove and the appearance of two symbols 50 and 52 (two stars in the embodiment illustrated), indicating that a particular prize has been won.

Figure 6:
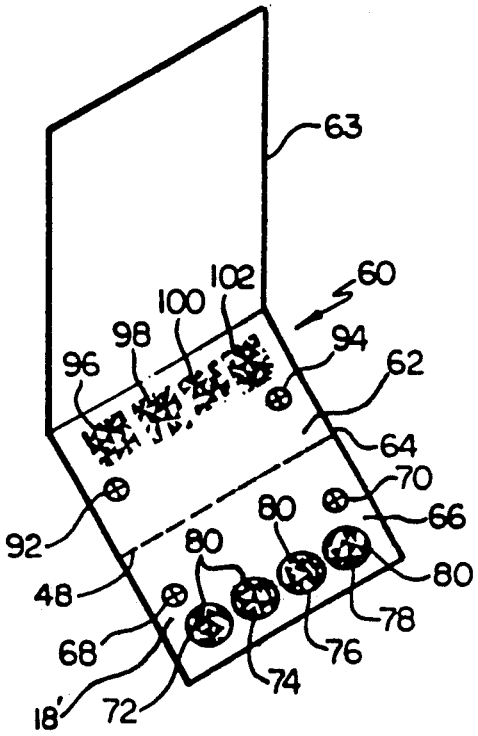
FIG. 6 is a perspective view of a product package having the gamepiece of the present invention printed thereon.

FIG. 6 illustrates the present invention embodied in a product package 60, the package being opened to show a portion of printed gamepiece 62. In this version, package 60 comprises two separate, multiple plastic layer sheets 63 and 64. Sheet 63 has product information printed thereon and sheet 64 has gamepiece 62 printed thereon. The product (not shown) is contained within package 60 when presented for sale to the purchasing public. FIG. 6 only shows one surface of the gamepiece 62, the other surface corresponding to surface 14 of label 10 as shown in FIGS. 1 and 3. As illustrated, the viewable front surface of layer 64 corresponds to surface 18 of label 10 as shown in FIGS. 2 and 4 and will be referred to as surface 18'. It should also be noted that in the embodiment illustrated, gamepiece 62, in essence, comprises a substantial portion of surface 18'. Gamepiece 62 comprises a lower portion 66 having alignment areas 68 and 70 and four transparent areas 72, 74 76 and 78. As described with reference to the embodiment shown in FIGS. 1-5, the transparent areas are formed with printing markings 80 thereon. In the same manner as described with reference to FIGS. 1-5, the customer, after purchasing the product package, has access to layer 64 and folds the layer in a manner such that areas 68 and 70 are in alignment with areas 92 and 94 respectively, areas 92 and 94 also having alignment markings printed thereon. When aligned, the product purchaser can visually ascertain whether he or she has won a prize by observing whether a particular symbol, such as a star, appears through the transparent areas 72, 74, 76 or 78. The type of prize awarded typically is based on the number of symbols appearing.

Figure 7:
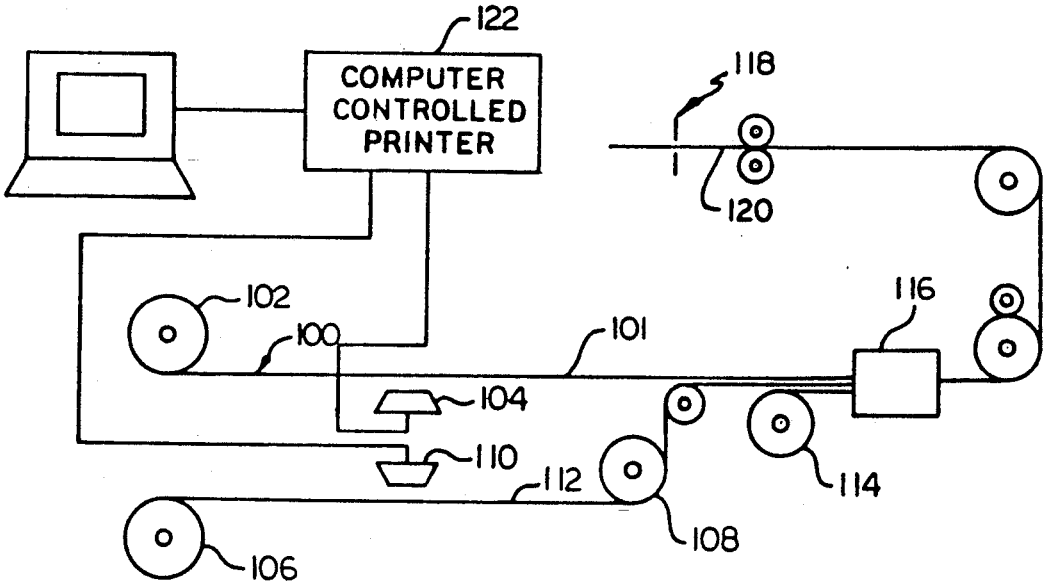
FIG. 7 is a schematic diagram of a process for making the labels shown in FIG. 1.

FIG. 7 shows a typical but simplified production line for preparing, for example, label 10 as shown in FIG. 1. In the production process as depicted, a web 100 of base plastic sheet stock is unrolled at 102 and advanced through a printing station 104 at which it is provided with printing, on face 101 of the web with a succession of patterns of product information and one portion of the gamepiece 12 (surface 101, in this case, corresponds to surface 25 of layer 19 as shown in FIG. 4*a*). Lithography is the preferred form of printing for the multilayered, transparent plastic material used in the label and packaging industry and which is utilized in the present invention. As is well known, various patterns of indicia can be formed on a selected layer surface by applying or not applying printing material thereto. For example, the diamond shaped transparent areas on the gamepiece are actually formed by not applying opaque printing material to a diamond shaped portion of the transparent plastic material.

A second web 106 of transparent plastic material is unrolled and advanced by roller 108 to printing station 110, the second portion of gamepiece 12 being printed on surface 112 of web 106 (surface 112 corresponds to surface 27 of layer 21 as shown in FIG. 4*a*). A third web 114 of transparent plastic material is unrolled and the three plastic layers are sealed together in a conventional manner in device 116.

At a subsequent station 118, the resulting continuous stock 120 may be transversally perforated and folded or rolled up to provide a series of labels 10 which may be field-severed into individual units, or successive increments may be severed at the station 118 from the leading end of the continuous stock 120 to be furnished to the product manufacturer. In practice, the printing stations 104 and 110 may be co-located, or at least controlled from a common control station 122.

Although lithography is the preferred form of printing, other forms can be used, such as flexography, letterpress, silk screening, etc. Further, although the printing of the gamepiece portion is preferably done on two sequential internal plastic layer surfaces, such as adjacent layer surfaces 25 and 27, 27 and 29, or 29 and 31, printing can also be accomplished on surfaces 17 and 25 or on surfaces 31 and 33.

While the invention has been described with reference to its preferred embodiments, it will be understood by those skilled in the art that various changes may be made and equivalents may be substituted for elements thereof without departing from the true spirit and scope of the invention.

What is claimed is:

1. A label construction for a product, a first surface of said label being securable to said product, a second surface of said label being exposed to viewing by a product purchaser, the improvement comprising a gamepiece integral with said label, a first portion of said gamepiece being printed to be viewable from said first surface of said label, product identification indicia also being printed to be viewable from said first surface, a second portion of said gamepiece being printed to be viewable from said second surface of said label, said second portion of said gamepiece having upper and lower portions, said lower portion being printed in a manner such that transparent areas having a first set of markings are formed thereon, first alignment means formed on the lower portion of said gamepiece, said first alignment means comprising a transparent area having first alignment markings formed thereon, the upper portion of said gamepiece having a second set of markings printed thereon; and second alignment means printed to be viewable from the upper portion of said gamepiece and comprising second alignment markings, the gamepiece, after removal from the label, providing a visual indication through the transparent areas on said lower portion of said gamepiece to the product purchaser whether a prize has been won when folded such that the first alignment markings are in alignment with said second alignment markings.

2. A package construction for a retail product comprising first and second sheets joined in a manner such that a product is contained therein, said second sheet comprising transparent plastic material, a first surface of said second sheet being exposed to viewing by a product purchaser, the improvement comprising a gamepiece integral with said second sheet, a first portion of said gamepiece being printed to be viewable from said first surface of said second sheet, product identification indicia also being printed to be viewable from said first surface of said second sheet, the second portion of said gamepiece printed to be viewable from the second surface of said second sheet, said gamepiece having upper and lower portions, said lower portion being printed in a manner such that transparent areas having a first set of markings are viewable thereon, and first alignment means formed on the lower portion of said gamepiece, said first alignment means comprising a transparent area having first alignment markings formed thereon, said upper portion of said gamepiece having a second set of markings printed thereon and further including, second alignment means printed thereon, said second alignment means comprising second alignment markings, and wherein the gamepiece, after removal from said second sheet, provides a visual indication through the transparent areas on said lower portion of said gamepiece to the product purchaser whether a prize has been won when folded such that the first alignment markings are in alignment with said second alignment markings.

* * * * *